United States Patent [19]

Raleigh

[11] Patent Number: 4,957,160

[45] Date of Patent: Sep. 18, 1990

[54] SELF-CLAMPING BAFFLE FOR TUBULAR STRUCTURES

[75] Inventor: William F. Raleigh, Santa Clarita, Calif.

[73] Assignee: Gas Research Institute, Chicago, Ill.

[21] Appl. No.: 445,281

[22] Filed: Dec. 4, 1989

[51] Int. Cl.[5] ..... F28F 9/22

[52] U.S. Cl. ..... 165/160; 165/159

[58] Field of Search ..... 165/159, 160, 161, 162

[56] References Cited

U.S. PATENT DOCUMENTS

| | | | |
|---|---|---|---|
| 1,805,652 | 5/1931 | Caracristi | 165/159 |
| 1,830,412 | 11/1931 | Stark | 165/160 |
| 2,350,976 | 6/1944 | Worn | 165/176 |
| 2,396,650 | 3/1946 | Hannah | 165/160 X |
| 2,568,984 | 9/1951 | Bowsher | 165/160 X |
| 2,587,801 | 3/1952 | Woods | 165/160 X |
| 2,804,284 | 8/1957 | Otten | 165/160 X |
| 3,074,480 | 1/1963 | Brown, Jr. et al. | 165/160 |
| 3,139,927 | 7/1964 | Binner et al. | 165/159 |
| 3,802,499 | 4/1974 | Garcea | 165/160 |
| 4,456,058 | 6/1984 | Powell | 165/162 |

FOREIGN PATENT DOCUMENTS

| | | | |
|---|---|---|---|
| 0023849 | 2/1980 | Japan | 165/162 |
| 0114979 | 5/1926 | Switzerland | 165/160 |
| 0620291 | 3/1949 | United Kingdom | 165/160 |
| 950548 | 2/1964 | United Kingdom . | |

OTHER PUBLICATIONS

Technology Profile, Gas Research Institute, Oct. 1985.
Building Loyalty to Natural Gas, Gas Research Institute Digest, vol. 9, No. 1, Spring 1986.
High Efficiency Hydronic Heating Unit, Gas Research Institute, Jan. 1987.

*Primary Examiner*—John Rivell
*Assistant Examiner*—L. R. Leo
*Attorney, Agent, or Firm*—Benoit Law Corporation

[57] ABSTRACT

A baffle for a tubular structure of at least two pairs of spaced tubes comprises a first baffle sheet having two portions curved in accommodation of spaced tubes in one of the pairs, and a second baffle sheet having another two portions curved in accommodation of spaced tubes in the other of the pairs when said baffle is inserted in between these two pairs of spaced tubes. These first and second baffle sheets are structurally interconnected and biased away from each other for self-clamping retention between the two pairs of spaced tubes. The first and second baffle sheets preferably are spaced from each other for their clearing corresponding spaced tubes when they are moved toward each other against the above menbtioned bias for an insertion in between the pairs of spaced tubes.

23 Claims, 1 Drawing Sheet

SELF-CLAMPING BAFFLE FOR TUBULAR STRUCTURES

BACKGROUND OF THE INVENTION

1. Field of the Invention

The subject invention relates to baffle structures and, more specifically, to baffles for use in heat exchangers and other tubular structures, and to combinations of baffles and such tubular structures.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

The need for and utility of various types of baffles have been known for a long time. Reference may in this respect be had to U.S. Pat. No. 1,830,412, by W. E. Stark, issued November 3, 1931, for an air heater in which various baffles increase effective surface and efficiency. Reference may also be had to U.S. Pat. No. 2,396,650, by P. C. Hannah, issued March 19, 1946, for a heat exchanger unit including a baffle contacted and supported by heat exchanger pipes or tubes, U.S. Pat. No. 2,350,976, by G. A. Worn, issued June 6, 1944, for a heat exchanger with an extended heat-conducting surface in the form of external fins extending along the tubing to increase the heat conduction between a fluid within the tubing and the fluid surrounding the tubing, U.S. Pat. No. 2,568,984, by C. A. Bowsher, issued September 25, 1951, for a heat exchanger unit including partitions for baffles and a spacing clip on a baffle end corrugated to provide on upper and lower surfaces of the baffle formations complimenting and receiving the expanded ends of heat exchanger pipes or tubes, U.S. Pat. No. 2,587,801, by J. E. Woods, issued March 4, 1952 for an oil cooler having a core baffled for axial flow by baffles inserted into spaces between heat exchanger tubes. Each baffle is provided with wings bent over mainly for baffle retention purposes. Reference may further be had to U.S. Pat. No. 2,804,284, by P. S. Otten, issued Aug. 27, 1957, for a heat exchanger including a finned structure forming triangularly shaped conduits in parallel to and coextensive with adjacent tubes and sheet metal members, and British Patent Specification No. 950,548, published Feb. 26, 1964 in the name of Young Radiator Company, and disclosing tubular heat exchangers including primary and supplemental baffles which may be corrugated or undulating and are interposed between or partially embrace immediately adjacent and staggered rows of tubes.

Without limitation to any field of application, the need for novel or improved baffles has increased through the introduction of hydronic heating systems of the type disclosed in Gas Research Institute publication entitled TECHNOLOGY PROFILE, published October 1985, and BUILDING LOYALTY TO NATURAL GAS, Gas Research Institute Digest, Vol. 9, Spring 1986.

SUMMARY OF THE INVENTION

It is a general object of this invention to provide improved baffle structures.

It is a germane object of this invention to provide improved baffles which are self-clamping or which otherwise retain themselves in a heat exchanger or other tubular structure, without the usual baffle mounting and fastening devices.

It is a related object of this invention to provide improved unitary structures of heat exchangers or other tubular structures with self-clamping baffles retained therein.

Other objects will become apparent in the future course of this disclosure.

From one aspect thereof, the invention resides in a baffle for a tubular structure of at least two pairs of spaced tubes, comprising in combination, a first baffle sheet having two portions curved in accommodation of spaced tubes in one of the pairs, and a second baffle sheet having another two portions curved in accommodation of spaced tubes in the other of the pairs when the baffle is inserted in between the two pairs of spaced tubes, these first and second baffle sheets being structurally interconnected and biased away from each other for self-clamping retention between the two pairs of spaced tubes.

From a related aspect thereof, the invention resides in a baffle for a tubular structure of at least two pairs of spaced tubes, comprising in combination, a first baffle sheet and a second baffle sheet jointly having a spearhead-like contour in cross-section, these first and second baffle sheets being structurally interconnected at a tip of the spearhead-like contour, the first baffle sheet having a first portion curving downwardly and outwardly from the tip in accommodation of a first tube in one of the two pairs, and having a concave second portion below the first portion, as seen from the tip, in accommodation of the second tube in the one pair, the second baffle sheet having also a first portion curving downwardly and outwardly from the tip in accommodation of a first tube in the other of the two pairs of spaced tubes, and having also a concave second portion below the latter first portion of the second baffle sheet, as seen from the tip, in accommodation of the second tube of the other pair, and these first and second baffle sheets being biased away from each other for self-clamping retention between the two pairs of spaced tubes.

The invention also resides in a method of providing a tubular structure of at least two pairs of spaced tubes with a baffle, comprising in combination the steps of providing a first baffle sheet with two portions curved in accommodation of spaced tubes in one of the pairs, providing a second baffle sheet with another two portions curved in accommodation of spaced tubes in the other of the pairs when the baffle is inserted in between said two pairs of spaced tubes, structurally interconnecting the first and second baffle sheets, biasing the first and second baffle sheets away from each other for self-clamping retention between the two pairs of spaced tubes, and inserting the interconnected and biased first and second baffle sheets in between the two pairs of spaced tubes for self-clamping retention therein by the biasing of the first and second baffle sheets away from each other.

Baffle sheets of baffles according to the subject invention may also be used to provide constricted gas or fluid passages between finned tubes and other tubular structures for higher efficiency, increased cooling and even condensation of moisture from gases put through a heat exchanger including the tubular structure, for instance.

BRIEF DESCRIPTION OF THE DRAWINGS

The subject invention and its objects and aspects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENT

The drawings show a baffle 10 for a tubular structure 12 of at least two pairs of spaced tubes 13, 14, 15 and 16. These tubes may be part of a heat exchanger or other tubular structure 18 which may, for instance, include headers, one of which is partially visible at 19 in FIG. 2. Reference may in this respect also be had to the disclosure of the above mentioned patents, which are hereby incorporated by reference herein. However, it should be understood that the subject invention is not in its utility or otherwise limited to heat exchangers or other specific tubular structures.

Figure 2:
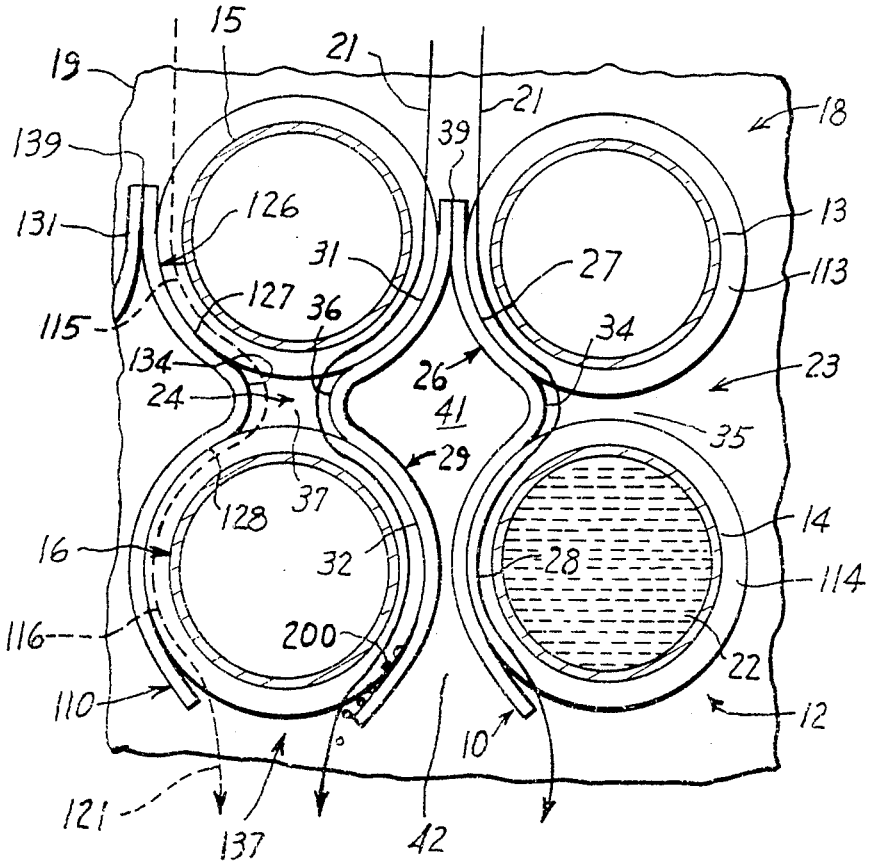
FIG. 2 is an elevation, partially in section, of a combined baffle and tubular structure according to an embodiment of the invention.

Nevertheless, the embodiment illustrated in FIG. 2 is structured in terms of an exchange of heat between a first fluid 21 and a second fluid 22. By way of example, the first fluid 21 may be a gas and the second fluid 22 may be a liquid. Accordingly, baffles of the type herein disclosed may, for instance, be used in gas-fired water heaters or in heat exchangers of air conditioners or coolers. However, these are just examples, since the utility of the invention obviously is not so limited. Also, for the purpose of simplicity, only two instances of flow of the first fluid 21 are shown in FIG. 2, and the second fluid or medium 22 is only shown in one of the tubes, even though there typically is a fluid or medium in all of the tubes.

For the purpose of disclosure, the four tubes 13 to 16 are considered arranged in two pairs 23 and 24, with the pair 23 comprising tubes 13 and 14, and the pair 24 comprising tubes 15 and 16. However, the subject invention is not limited to that breakdown of tubes into pairs or even to any such breakdown, for that matter.

Nevertheless, the illustrated preferred baffle 10 of the invention comprises a first baffle sheet 26 having two portions 27 and 28 curved in accommodation of spaced tubes 13 and 14 of one of the pairs 23, and a second baffle sheet 29 having another two portions 31 and 32 curved in accommodation of spaced tubes 15 and 16 in the other pair 24 when the baffle is inserted in between the two pairs of spaced tubes. These first and second baffle sheets 26 and 29 are structurally interconnected and biased away from each other for self-clamping retention between the two pairs of spaced tubes 23 and 24.

Depending on the interpretation of "tubes" within the scope of the subject invention, the baffles or baffle sheets may engage the tubes physically or may, for instance, engage certain elements on the actual tubes. In this respect, many tubes in heat exchangers and other tubular structures carry fins for increased effective surface and efficiency. Accordingly, FIG. 2 broadly shows external fin structures 113, 114, 115 and 116 for the tubes 13, 14, 15 and 16, respectively. However, such and other fin or surface increasing structures may be considered as part of the tubes themselves, and are so considered in the disclosure of the subject invention. Accordingly, the baffle sheets 26 and 29 may be considered as not only accommodating but in effect engaging the illustrated tubes 13 to 16, even though they actually engage the tubular fin structures 113 to 116 so as to leave lateral passages for the flow of the first fluid 21 through the tubular structure.

In terms of method, the subject invention provides a tubular structure of at least two pairs of spaced tubes 23 and 24 with a baffle 10, by providing a first baffle sheet 26 with two portions 27 and 28 in accommodation of spaced tubes 13 and 14 in one of the pairs 23, and by providing a second baffle sheet 29 with another two portions 31 and 32 curved in accommodation of spaced tubes 15 and 16 in the other pair 24 when the baffle is inserted in between such two pairs of spaced tubes.

The invention structurally interconnects the first and second baffle sheets and biases such first and second baffle sheets 26 and 29 away from each other for self-clamping retention between the two pairs of spaced tubes 23 and 24.

In principle, the first and second baffle sheets 26 and 29 may in actuality be provided by an appropriate bending of a single baffle sheet. However, cutting and bending the baffle sheets 26 and 29 from one sheet and interconnecting such cut baffle sheets at the top is presently preferred. By way of example, the curved baffle sheets may be interconnected at the top by spot welding or by another appropriate technique.

The presently disclosed method inserts the interconnected and biased first and second baffle sheets 26 and 29 in between the two pairs of spaced tubes 23 and 24 for self-clamping retention therein by the biasing of such first and second baffle sheets away from each other.

The first baffle sheet has or is provided with an outward projection 34 between the curved portions 27 and 28 thereof at the location on that first baffle sheet corresponding to a space 35 between the spaced tubes 13 and 14 in one of the pairs 23. Similarly, the second baffle sheet has another outward projection 36 between the other curved portions 31 and 32 thereof at the location on that second baffle sheet 29 corresponding to another space 37 between the spaced tubes 15 and 16 in the other pair 24.

The illustrated method according to the invention retains the interconnected and biased baffle sheets 26 and 29 within the pairs of spaced tubes 23 and 24 with the aid of those projections 34 and 36. Pursuant to a preferred embodiment of the invention, the first and second baffle sheets 26 and 29 are made resilient and for that purpose may be cut from resilient stock or may otherwise be manufactured from a resilient material. In this or any other manner, the first and second baffle sheets 26 and 29 have or are provided with an internal bias away from each other.

The first and second baffle sheets 26 and 29, or several baffles 10, may be combined into a unitary structure with the tubular structure 12 or 18; an example of such a unitary structure being apparent from FIG. 2.

According to a preferred embodiment of the invention, the first and second baffle sheets 26 and 29 are provided with a contour in cross-section having a tip 39 where the first and second baffle sheets are structurally interconnected and having below that tip a hollow interior 41 with an open bottom 42 reducible in width against the above mentioned bias for an self-clamping retention of the interconnected first and second baffle sheets 26 and 29 or of the baffle 10 between the two pairs of spaced tubes 23 and 24.

Figure 1:
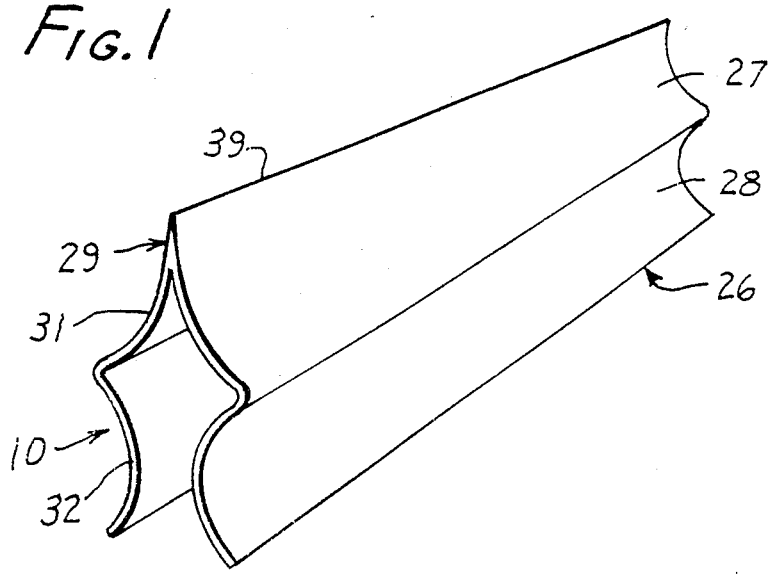
FIG. 1 is a perspective view of a baffle according to a preferred embodiment of the invention.

According to a preferred embodiment of the invention, the first baffle sheet 26 and the second baffle sheet 29 jointly have a spearhead-like contour in cross-section, as apparent, for example, from FIGS. 1 and 2. These first and second baffle sheets are structurally interconnected at a tip 39 of that spearhead-like contour.

The interconnected first and second baffle sheets 26 and 29 having the illustrated spear-like contour are inserted in between the two pairs of spaced tubes 23 and 24, and such interconnected first and second baffle sheets are lodged with their lateral projections 34 and 36 in such pairs of spaced tubes.

As seen in the drawings, the first baffle sheet 26 has a first portion 27 curving downwardly and outwardly from the tip 39 in accommodation of a first tube 13 in one of the two pairs 23, and has a concave second portion 28 below that first portion, as seen from the tip, in accommodation of the second tube in that one pair. Similarly, the second baffle sheet 29 also has a first portion 31 curving downwardly and outwardly from the tip in accommodation of a first tube 15 in the other pair of spaced tubes 24, and has also a concave second portion 32 below the latter first portion 31 of the second baffle sheet, as seen from the tip, in accommodation of the second tube 16 of the other pair 24. The first and second baffle sheets 26 and 29 are biased away from each other for self-clamping retention between the two pairs of spaced tubes, such as with the concave portions 28 and 32 at the tubes 14 and 16 or tubular structures 114 and 116, respectively. In the disclosed configuration of the baffle cross-section, the baffle portions 28 and 32 may be designed relative to the tubular structures 114 and 116 to give the baffle 10 an upward component whereby the baffle is provided with a vertical bias in the direction of the tip which moves also the upper baffle portions -27 and 31 into conformity with the baffle structures 113 and 115.

The lateral projections 34 and 36 are also part of the spearhead-like contour as seen in FIGS. 1 and 2, and the first and second baffle sheets are sufficiently spaced from each other below the tip 39 for movement against each other against their bias, until these outward projections or the spearhead-like contour clears corresponding tubes 14 and 16 or tubular structures 114 and 116 for insertion of the interconnected first and second baffle sheets in between the two pairs 23 and 24.

For clarity of illustration and disclosure, FIG. 2 shows baffle 10 in a rather simple tubular structure. While this is within the scope of the subject invention, it typically will be necessary in practice to use several of the baffles 10, if not a multitude of such baffles, in order to increase effective surface and provide the desired narrowed or undulating fluid flow path through the tubular structure or past the tubes thereof. As a particular advantage, the baffles of the subject invention are easily installed and are self-clamping within the tubular structure, thereby dispensing with the need for the usual baffle mounting and fastening devices.

In addition to these advantages, the baffles according to the subject invention are easily and efficiently manufactured, especially in the forms herein disclosed.

The baffles of the subject invention are very effective in heat exchangers and other tubular structures where their presence increases effective surface area and efficiency substantially.

The preferred embodiment of the invention illustrated in FIG. 2 includes a second baffle 110 including a third baffle sheet 126 having a first portion 127 curving downwardly and outwardly in accommodation of a fourth finned tube 15 in the tubular structure 12. The second and third baffle sheets 29 and 126 have projections 36 and 134 toward each other between the first and second portions 31 and 32 of the second baffle sheet and between the first and second portions 127 and 128 of the third baffle sheet 126, respectively, providing a constricted gas passage 37 between the third and fourth finned tubes 15 and 16. The second portion 128 of the baffle sheet 126 may also be concave for accommodating the fourth finned tube 16 and for defining a further constricted passage 137 in cooperation with the concave second portion 32 of the baffle sheet 29.

FIG. 2 also shows only diagrammatically that the second baffle 110 may have a fourth baffle sheet 131, which may be of the same design or configuration as the baffle 29, for instance. In that case, the third and fourth baffle sheets 127 and 131 of the second baffle 126 jointly would also have a spearhead-like contour in cross-section. The third and fourth baffle sheets 127 and 131 are structurally interconnected at a tip 139 of the latter spearhead-like contour. These interconnected third and fourth baffle sheets 127 and 131 are also biased away from each other for self-clamping retention of the second baffle 126 in the tubular structure 12 at said third and fourth finned tubes 15 and 16.

The baffle sheets, including baffle sheets 29 and 127, are provided with lateral projections, such as the lateral projections 36 and 134 out of the spearhead-like contours, to realize constricted gas passages, such as the gas passage 37 between the finned tubes 15 and 16.

The constricted gas passages provided according to the illustrated embodiment or otherwise within the scope of the invention are highly effective to increase interaction or heat exchange between the first and second fluids 21 and 22. In this respect, the expression "gas" in "gas passages" may refer to any fluid, whether gaseous or not. However, the efficacy of the constricted passage 37 is now explained with the example of a hot gas that is forced downwardly, as seen at 21 and 121 in FIG. 2, to heat a liquid 22 in the tubes 12.

In that case, the gas may, for instance, have a temperature of about 2000° F. and would be cooled to about 300° F. in a typical heat exchanger. At that output temperature, the gas could and in many cases would harm the environment. Also, a temperature drop of only to as high as 300° F. puts a limit on attainable efficiency.

The subject invention, however, enables a temperature drop of the gaseous fluid to as low as body temperature, by having the baffles 10, 110, etc., provide the constricted gas passages, such as at 37, 137, etc. In general, the subject invention permits the temperature of the first fluid 21 to be dropped to within 5°–10° F. above the second fluid 22 being heated by the heat exchange with baffles 10, 110, etc. These baffles substantially increase the efficacy of the second row of tubes 14, 16 while also increasing the efficiency of the first row of tubes 13, 15 in the direction of flow of the first fluid 21.

Such constricted passages effect a sufficient cooling of the fluid 21, 121 for a condensation of moisture from the gaseous component. The resulting condensate 200 may thus be collected and removed before the gas is released in a substantially cooled condition to the atmosphere, for instance.

While the disclosure so far and the claims emphasize utility for a tubular structure of at least two pairs of spaced tubes, the baffles according to the subject invention may also be used between two tubes at a time. For instance, even if the top tubes 13 and 15 are considered omitted, it would still be apparent from FIG. 2 that the baffle 10 is retained at its concave portions 28 and 32 between the lower tubes 14 and 16 or tubular structures 114 and 116, with the top baffle parts 27 and 31 then simply sticking up into the air or into another part of the interior of apparatus 18 for use therein.

Furthermore, the subject extensive disclosure will suggest or render apparent to those skilled in the art various modifications and variations within the spirit and scope of the invention and equivalents thereof.

I claim:

1. A baffle for a tubular structure of at least two pairs of spaced tubes, comprising in combination:

a first baffle sheet having two portions curved in accommodation of spaced tubes in one of said pairs; and a second baffle sheet having another two portions curved in accommodation of spaced tubes in the other of said pairs when said baffle is inserted in between said two pairs of spaced tubes;

said first and second baffle sheets being structurally interconnected and biased away from each other for self-clamping retention between said two pairs of spaced tubes.

2. A baffle as claimed in claim 1, wherein:

said first baffle sheet has an outward projection between said curved portions thereof at a location on said first baffle sheet corresponding to a space between the spaced tubes in one of said pairs; and said second baffle sheet has another outward projection between said other curved portions thereof at a location on said second baffle sheet corresponding to another space between the spaced tubes in the other of said pairs.

3. A baffle as claimed in claim 2, wherein:

said first and second baffle sheets have an internal bias away from each other and are resilient for movement toward each other against said bias.

4. A baffle as claimed in claim 3, wherein:

said first and second baffle sheets have a contour in cross-section having a tip where said first and second baffle sheets are structurally interconnected, and having below said tip a hollow space with an open bottom opposite said tip.

5. A baffle as claimed in claim 1, wherein:

said first and second baffle sheets have an internal bias away from each other and are resilient for movement toward each other against said bias.

6. A baffle as claimed in claim 5, wherein:

said first and second baffle sheets have a contour in cross-section having a tip where said first and second baffle sheets are structurally interconnected, and having below said tip a hollow space with an open bottom opposite said tip.

7. A baffle as claimed in claim 1, wherein:

said first and second baffle sheets have a contour in cross-section having a tip where said first and second baffle sheets are structurally interconnected, and having below said tip a hollow space with an open bottom opposite said tip.

8. A baffle for a tubular structure of at least two pairs of spaced tubes, comprising in combination:

a first baffle sheet and a second baffle sheet jointly having a spearhead-like contour in cross-section;

said first and second baffle sheets being structurally interconnected at a tip of said spearhead-like contour;

said first baffle sheet having a first portion curving downwardly and outwardly from said tip in accommodation of a first tube in one of said two pairs, and having a concave second portion below said first portion, as seen from said tip, in accommodation of the second tube in said one pair;

said second baffle sheet having also a first portion curving downwardly and outwardly from said tip in accommodation of a first tube in the other of said two pairs of spaced tubes, and having also a concave second portion below the latter first portion of said second baffle sheet, as seen from said tip, in accommodation of the second tube of said other pair; and said first and second baffle sheets being biased away from each other for self-clamping retention between said two pairs of spaced tubes.

9. A baffle as claimed in claim 8, wherein:

said spearhead-like contour has an outward projection between said first portion of the first baffle sheet and said concave second portion thereof at a location on said first baffle sheet corresponding to a space between the spaced tubes in one of said pairs; and said spearhead-like contour has another outward projection between said other first portion of said second baffle sheet and said concave second portion thereof at a location on said second baffle sheet corresponding to another space between the spaced tubes in the other of said pairs.

10. A baffle as claimed in claim 8, wherein:

said first an second baffle sheets have a hollow space therebetween within said spearhead-like contour; and said hollow space has an open bottom thereof opposite said tip.

11. In a tubular structure, the improvement comprising in combination:

a first baffle comprising:

a first baffle sheet and a second baffle sheet jointly having a spearhead-like contour in cross-section;

said first and second baffle sheets being structurally interconnected at a tip of said spearhead-like contour;

said first baffle sheet having a first portion curving downwardly and outwardly from said tip in accommodation of a first finned tube in said tubular structure, and having a concave second portion below said first portion, as seen from said tip, in accommodation of the second finned tube in said tubular structure;

said second baffle sheet having also a first portion curving downwardly and outwardly from said tip in accommodation of a third finned tube in said tubular structure, and having also a concave second portion below the latter first portion of said second baffle sheet, as seen from said tip, in accommodation of a fourth finned tube in said tubular structure; and said first and second baffle sheets being biased away from each other for self-clamping retention between said finned tubes;

a second baffle including:

a third baffle sheet having a first portion curving downwardly and outwardly in accommodation of said fourth finned tube in said tubular structure and having a concave second portion for accommodating the fourth finned tube;

said second and third baffle sheets having projections toward each other between said first and second portions of said second baffle sheet and between said first and second portions of said third baffle sheet, respectively, providing a constricted gas passage between said third and fourth finned tubes.

12. A tubular structure as claimed in claim 11, wherein:

said second baffle has a fourth baffle sheet;

said third and fourth baffle sheets of said second baffle jointly having also a spearhead-like contour in cross-section;

said third and fourth baffle sheets being structurally interconnected at a tip of the latter spearhead-like contour; and said third and fourth baffle sheets being biased away from each other for self-clamping retention of said second baffle in said tubular structure at said third and fourth finned tubes.

13. A method of providing a tubular structure of at least two pairs of spaced tubes with a baffle, comprising in combination the steps of:

providing a first baffle sheet with two portions curved in accommodation of spaced tubes in one of said pairs;

providing a second baffle sheet with another two portions curved in accommodation of spaced tubes in the other of said pairs when said baffle is inserted in between said two pairs of spaced tubes;

structurally interconnecting said first and second baffle sheets, biasing said first and second baffle sheets away from each other for self-clamping retention between said two pairs of spaced tubes; and inserting the interconnected and biased first and second baffle sheets in between said two pairs of spaced tubes for self-clamping retention therein by said biasing of said first and second baffle sheets away from each other.

14. A method as claimed in claim 13, including the steps of:

providing said first baffle sheet with an outward projection between said curved portions thereof at a location on said first baffle sheet corresponding to a space between the spaced tubes in one of said pairs;

providing said second baffle sheet with another outward projection between said other curved portions thereof at a location on said second baffle sheet corresponding to another space between the spaced tubes in the other of said pairs; and retaining the interconnected and biased baffle sheets within said pairs of spaced tubes with the aid of said projections.

15. A method as claimed in claim 14, including the steps of:

making said first and second baffle sheets resilient; and providing said first and second baffle sheets with an internal bias away from each other for said self-clamping retention between said two pairs of spaced tubes.

16. A method as claimed in claim 13, including the steps of:

making said first and second baffle sheets resilient;

providing said first and second baffle sheets with an internal bias away from each other for said self-clamping retention between said two pairs of spaced tubes; and providing said first and second baffle sheets with a contour in cross-section having a tip where said first and second baffle sheets are structurally interconnected and having below said tip a hollow interior and an open bottom reducible in width against said bias for said self-clamping retention between said two pairs of spaced tubes.

17. A method as claimed in claim 13, including the steps of:

making said first and second baffle sheets resilient;

providing said first and second baffle sheets with an internal bias away from each other for said self-clamping retention between said two pairs of spaced tubes; and providing said first and second baffle sheets with a spearhead-like contour in cross-section having a tip where said first and second baffle sheets are structurally interconnected and having lateral projections;

inserting said interconnected first and second baffle sheets having said spearhead-like contour in between said two pairs of spaced tubes; and lodging said interconnected first and second baffle sheets with said spearhead-like contour in said pairs of spaced tubes.

18. A method as claimed in claim 13, including the steps of:

making said first and second baffle sheets resilient;

providing said first and second baffle sheets with an internal bias away from each other for said self-clamping retention between said two pairs of spaced tubes;

providing said first and second baffle sheets with a spearhead-like contour in cross-section having a tip where said first and second baffle sheets are structurally interconnected;

providing for said spearhead-like contour in said first baffle sheet a first portion curving downwardly and outwardly from said tip and accommodating a first tube in one of said two pairs, and a concave second portion below said first portion, as seen from said tip, accommodating the second tube in said one pair;

providing also for said spearhead-like contour in said second baffle sheet also a first portion curving downwardly and outwardly from said tip and accommodating a second tube in the other of said two pairs of spaced tubes, and also a concave second portion below the latter first portion of said second baffle sheet, as seen from said tip, accommodating the second tube of said other pair, when said first and second baffle sheets having said spearhead-like configuration are inserted in between said two pairs of spaced tubes.

19. A method as claimed in claim 18, including the steps of:

providing also for said spearhead-like contour said first and second baffle sheets with lateral projections between each first portion and each concave second portion; and lodging said interconnected first and second baffle sheets with said lateral projections in said pairs of spaced tubes.

20. A method as claimed in claim 13, including the step of:

combining said interconnected first and second baffle sheets into a unitary structure with said tubular structure.

21. A method as claimed in claim 13, including the steps of:

making said first and second baffle sheets resilient;

providing said first and second baffle sheets with an internal bias away from each other for said self-clamping retention between said two pairs of spaced tubes; and providing said first and second baffle sheets with a spearhead-like contour in cross-section having a tip where said first and second baffle sheets are structurally interconnected and having lateral projections;

inserting said interconnected first and second baffle sheets having said spearhead-like contour in between said two pairs of spaced tubes;

lodging said interconnected first and second baffle sheets with said spearhead-like contour in said pairs of spaced tubes;

providing a baffle including a third baffle sheet having two portions curved in accommodation of spaced tubes in the other of said pairs;

providing between the latter spaced tubes and along said second and third baffle sheets a constricted gas passage.

22. A method as claimed in claim 21, including the steps of:

providing said baffle with a fourth baffle sheet;

making said third and fourth baffle sheets resilient and structurally interconnecting said third and fourth baffle sheets;

providing said third and fourth baffle sheets with an internal bias away from each other for self-clamping retention in said tubular structure; and providing said third and fourth baffle sheets with a spearhead-like contour in cross-section having a tip where said third and fourth baffle sheets are structurally interconnected.

23. A method as claimed in claim 22, including the steps of:

providing at least predetermined ones of said baffle sheets with lateral projections to realize said constricted gas passage.

* * * * *